US008646226B2

(12) United States Patent
Barram

(10) Patent No.: US 8,646,226 B2
(45) Date of Patent: Feb. 11, 2014

(54) MODULAR VEHICLE SERVICE PIT

(76) Inventor: Peter J. Barram, Lake Oswego, OR (US)

( * ) Notice: Subject to any disclaimer, the term of this patent is extended or adjusted under 35 U.S.C. 154(b) by 417 days.

(21) Appl. No.: 12/914,821

(22) Filed: Oct. 28, 2010

(65) Prior Publication Data

US 2011/0099922 A1 May 5, 2011

Related U.S. Application Data

(60) Provisional application No. 61/257,331, filed on Nov. 2, 2009.

(51) Int. Cl.
*E02D 29/00* (2006.01)
*E04H 6/42* (2006.01)

(52) U.S. Cl.
USPC ..... 52/169.7; 52/169.6; 52/174; 52/79.1; 137/234.6; 184/1.5; 73/862

(58) Field of Classification Search
USPC ..... 405/52–55, 36; 52/169.6, 169.7, 302.1, 52/459, 79.1, 174, 182, 302.3; 249/DIG. 3; 73/431, 862.541, 862; 137/234.6; 184/1.5
See application file for complete search history.

(56) References Cited

U.S. PATENT DOCUMENTS 1,654,073 A * 12/1927 Fagan ..... 184/1.5
2,936,504 A * 5/1960 Le Roy ..... 405/266
3,374,491 A * 3/1968 Patin et al. ..... 52/169.7
3,603,046 A * 9/1971 Humphrey, Jr. ..... 52/173.1
3,866,624 A * 2/1975 Peterson ..... 137/234.6
4,226,062 A * 10/1980 Doane ..... 52/169.6
4,352,322 A * 10/1982 Brauer ..... 454/345
4,539,790 A * 9/1985 Zamboni ..... 53/227
4,789,047 A * 12/1988 Knobloch ..... 184/1.5
5,331,782 A 7/1994 Wohlgemuth
5,701,706 A * 12/1997 Kreysler et al. ..... 52/169.6
5,809,936 A * 9/1998 Wall ..... 119/484
6,152,652 A * 11/2000 Mosby ..... 405/52
6,539,678 B1 * 4/2003 Campbell et al. ..... 52/169.7
6,966,984 B1 * 11/2005 Solomon ..... 210/154
D545,263 S 6/2007 Ziaylek
D660,221 S * 5/2012 Barram ..... D12/400
2003/0192381 A1 * 10/2003 Kelly et al. ..... 73/431

OTHER PUBLICATIONS http://www.modulube.com/DSC_0037.jpg, 3pp, commercially available before Nov. 1, 2008.

(Continued)

*Primary Examiner* — Jeanette E. Chapman
(74) *Attorney, Agent, or Firm* — Stoel Rives LLP

(57) ABSTRACT

An exemplary vehicle service pit includes a first section and a second section abutting each other. A support structure supports the service pit and a joint plate helps hold the first section and the second section in the abutting relationship. Substantially parallel runners are located in the service pit and are secured to the support structure. A glider moveably mounts on the runners. Lights may be included as part of the service pit. An exemplary method for assembling a service pit includes abutting a head section and a foot section and securing a gasket in place over the joint between the head section and the foot section using a joint plate. Optionally, lights are added to the head section, the foot section, or both. Runners of elongate metal with support feet integrally formed are attached to the service pit by bolts, or other suitable fastener.

12 Claims, 7 Drawing Sheets

(56) References Cited

OTHER PUBLICATIONS http://www/atlanticautomotiveequipment.com/article.php/39/52/index.html, Oct. 26, 2009.

Design U.S. Appl. No. 29/346,572, Inventor: Peter Barram, filed Nov. 2, 2009, U.S. Pat. No. D660,221.

Design U.S. Appl. No. 29/417,539, Inventor: Peter Barram, filed Apr. 4, 2012, (divisional of U.S. Pat. No. D660,221), documents from file history: Notice of Allowance dated Aug. 11, 2013.

* cited by examiner

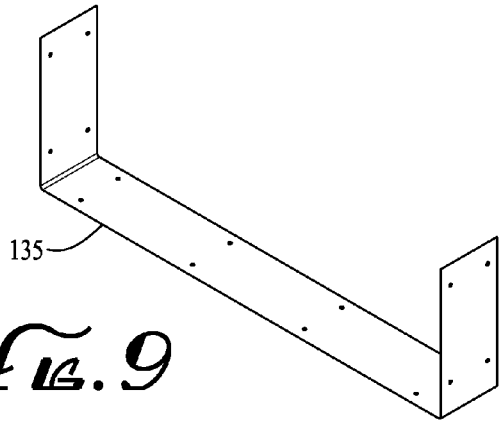
FIG. 9
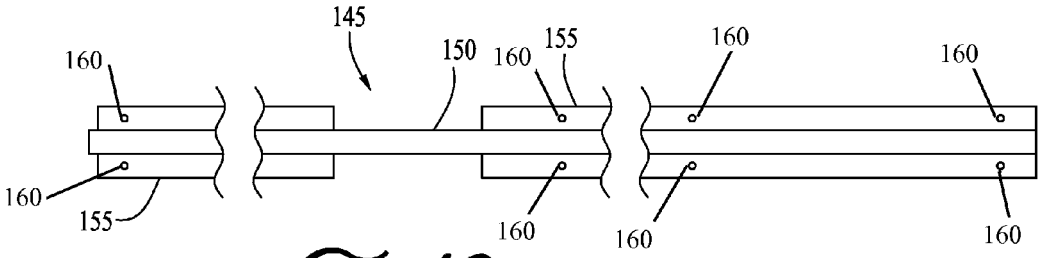
FIG. 10
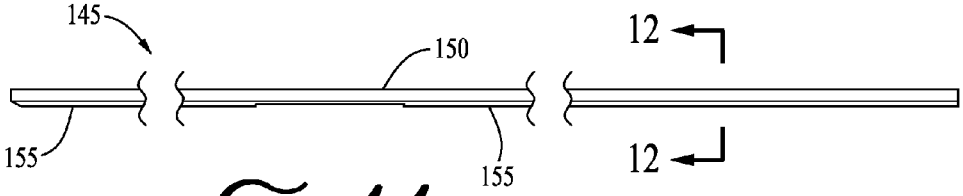
FIG. 11
FIG. 12
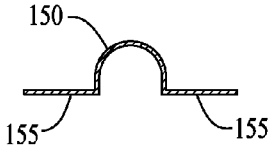

MODULAR VEHICLE SERVICE PIT

RELATED APPLICATION

This application claims priority under 35 U.S.C. 119(e) to U.S. Patent Application No. 61/257,331 filed Nov. 2, 2009 and titled "Modular Vehicle Service Pit," which is fully incorporated by reference herein.

TECHNICAL FIELD

The field of the present disclosure relates to vehicle service pits, and to modular vehicle service pits in particular.

BACKGROUND

Vehicle service pits are commonly included in service stations, quick oil change facilities and similar buildings where frequent access to the underside of a vehicle is needed. Many service pits are located in the ground, that is, below a building's grade level and either permit a service technician to stand up to access the underside of a vehicle, or to lie on a moveable glider to access the underside of a vehicle.

Current service pits are commonly constructed as a one-piece, or unitary, construction. For example, service pits may be constructed from poured concrete, either directly in the ground or in a form to create a concrete liner that is placed in the ground. Other current service pits are manufactured from steel, fiberglass, or plastics as a one-piece or unitary liner that is placed in the ground to form the service pit. Some current service pits are made from a relatively large number of pieces that are assembled on-site.

The present inventor has recognized several disadvantages with current service pits. One drawback with current unitary service pits is that such unitary construction may be complex or expensive and thus add to the cost of the unitary service pit. Another drawback with unitary service pits is that they require relatively high shipping fees due to the size and weight of the unitary piece. A further drawback with unitary service pits, which are commonly 22 feet in length, is that when shipped overseas, they typically require using a 40 foot cargo container instead of a less expensive 20 foot cargo container. Additionally, if a unitary service pit is punctured or damaged beyond repair, the entire unitary piece needs to be replaced. A drawback with a service pit made from a relatively large number of pieces assembled on-site is the time and expense associated with the on-site assembly, which typically requires experienced workers. The present inventor has recognized a need for a service pit that overcomes some, or all of the above-identified disadvantages.

SUMMARY

The present invention is directed to service pits and methods of manufacture and assembly thereof.

An exemplary service pit includes a head section and a foot section made from molded plastic that have identical, or substantially identical cross sections at least at one end. The head section and the foot section are supported by an underlying support structure. A generally U-shaped gasket is located on the two sections where they meet and a generally U-shaped joint plate is located on top of the gasket. Fasteners are driven through the joint plate, gasket, and the two sections near the meeting point into the support structure. Two substantially parallel runners are installed in the bottom of the two sections and secured through the bottom of each section to the support structure. A glider moveably mounts on the runners.

An exemplary method for manufacturing service pit components includes forming a single rotational mold for the head section and the foot section. The rotational mold is loaded with a polymer, then heated and rotated to melt the polymer and uniformly coat the inside of the rotational mold. While still rotating, the mold is cooled to set the polymer. The head section and the foot section are removed from the rotational mold. Optionally, lights are added to the head section, the foot section, or both. The joint plate is preferably manufactured from metal, and is stamped or otherwise suitably formed. The runners are preferably elongate metal with support feet integrally formed by stamping or other suitable manner, or attached by welding, bolting, or other suitable fastener.

Additional aspects and advantages will be apparent from the following detailed description of preferred embodiments, which proceeds with reference to the accompanying drawings.

BRIEF DESCRIPTION OF THE DRAWINGS

FIG. 9 is a top orthogonal view of an exemplary joint plate.

FIG. 10 is a top view of an exemplary runner.

FIG. 11 is a left side view of the runner of FIG. 10.

FIG. 12 is an end view of the runner of FIG. 10.

DETAILED DESCRIPTION OF PREFERRED EMBODIMENTS

Preferred embodiments of the present invention described below include service pits constructed from two separate sections joined together in a fluid leakage resistant manner. Other embodiments are directed to the manufacture of such service pits. The following description describes preferred embodiments but is not meant to limit the invention to the embodiments described.

Figure 3:
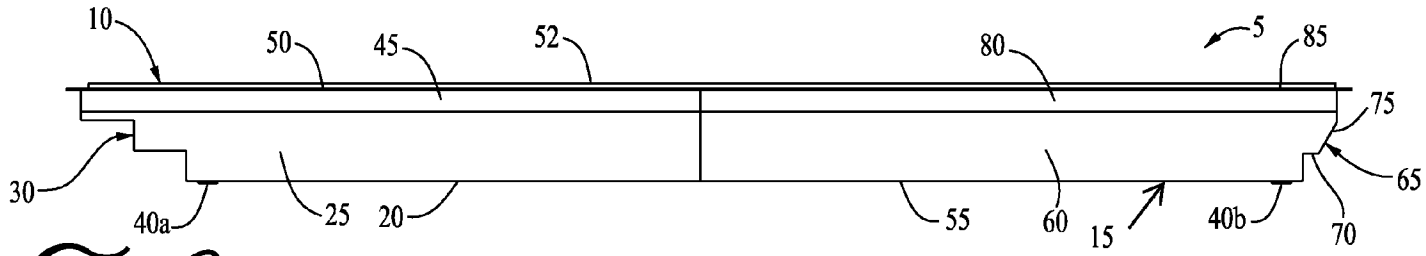
FIG. 3 is a left side view of the service pit of FIG. 1.
Figure 4:
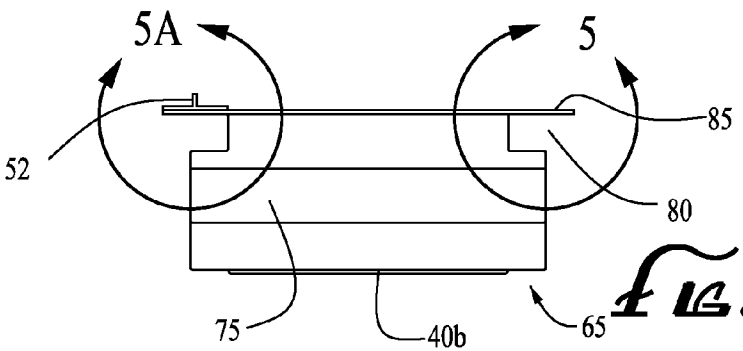
FIG. 4 is a foot end view of the service pit of FIG. 1.
Figure 8:
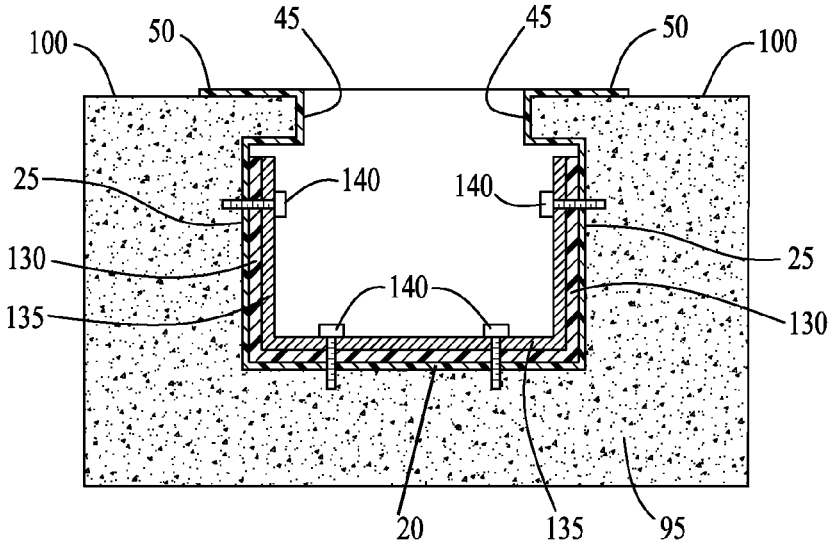
FIG. 8 is a cross sectional view of a joint plate securing a gasket and the service pit of FIG. 1 to a concrete support structure.

FIGS. 1-4 illustrate a service pit 5 formed from a head section 10 and an abutting foot section 15 positioned end to end with respect to each other. Head section 10 includes a floor 20, two side walls 25 and a head wall 30. As best seen in FIG. 3, head wall 30 preferably has a stepped profile that includes one or more steps 35, for example, the illustrated head wall 30 includes two steps 35, 35. The steps 35 may facilitate access to the interior of pit 5 when a vehicle straddles pit 5. The floor 20 is preferably formed with a catch basin 40*a* to retain fluids that may enter pit 5. The catch basin 40*a* is of suitable depth, preferably ¾ of an inch deep, 4 inches wide, and spans the width of floor 20 for catching and retaining fluids dropping from a vehicle or otherwise entering pit 5. Other suitable dimensions may be used. Head section 10 preferably includes front light rails 45 which receive a light 82 as described below. Lights 82 are optional. In a preferred embodiment, the upper surface of front light rails 45 (flush with lip 50 in as shown in FIG. 8) provides a surface for oil drain pan wheels to ride upon. As best seen in FIGS. 4 and 5, front light rails 45 preferably have a rectangular cross section and are preferably approximately 4 and ⅞ inches high by approximately 4 and ¾ inches wide. However, other suitable dimensions may be used. Head section 10 also preferably includes a lip 50 extending radially outward from a top peripheral edge, the lip 50 overlying a building floor when pit 5 is installed as described below. The floor 20, side walls 25, head wall 30, catch basin 40*a*, front light rails 45, and lip 50 each have a suitable thickness for providing structural integrity during manufacture, shipping, installation, and use of pit 5. Preferably, a suitable thickness is about ¼ of an inch, but may vary.

Figures 2, 5, 5A:
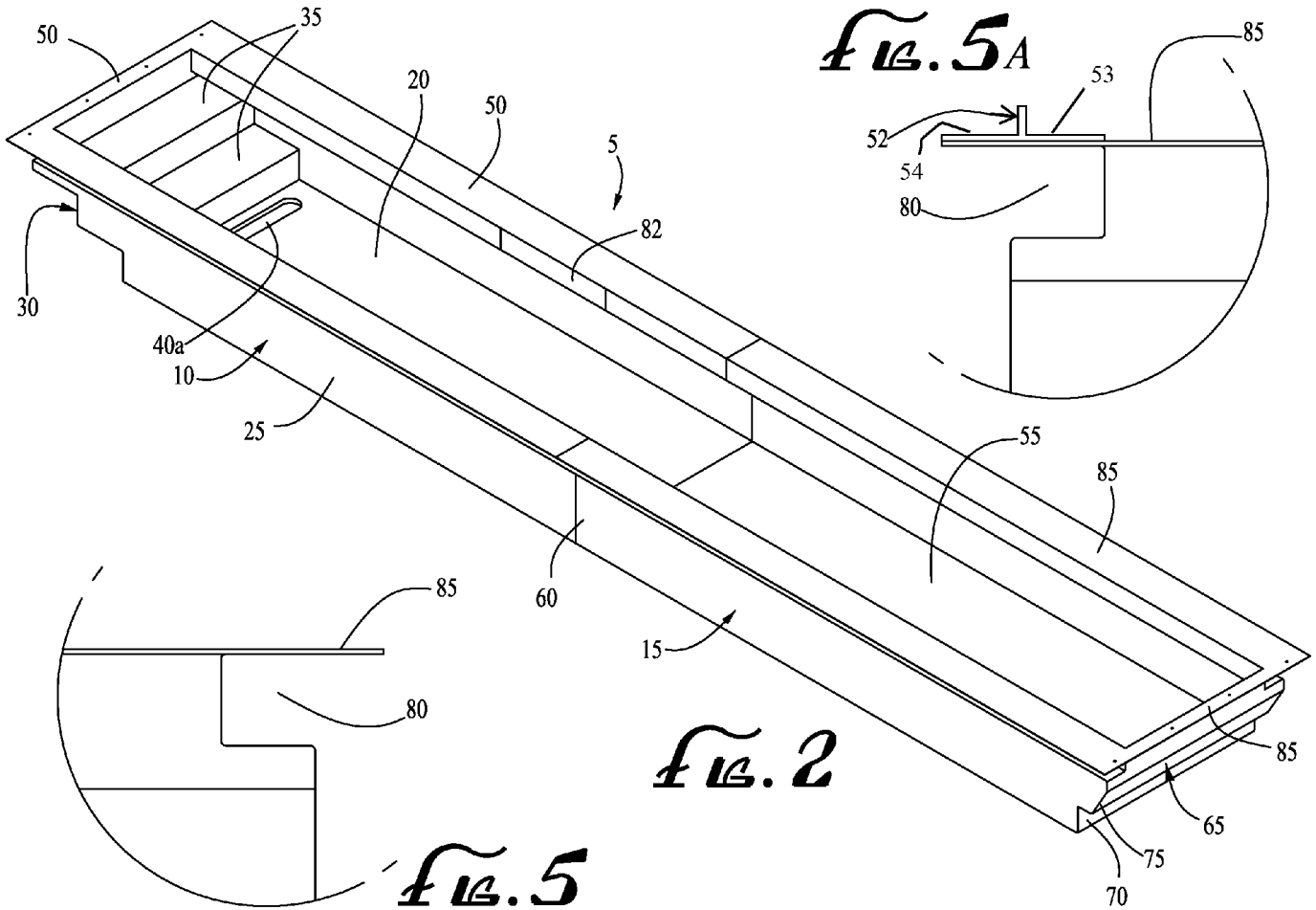
FIG. 2 is a top orthogonal view of the service pit of FIG. 1.
FIG. 5 is a detailed view of a portion of FIG. 4 showing details of the light rail of the service pit and FIG. 5A is a detailed view of a portion of FIG. 4 showing details of the guide rail.

Foot section 15 includes floor 55, two side walls 60 and a foot wall 65. As best seen in FIG. 3, the foot wall 65 preferably has a stepped profile that includes one or more steps 70 and a sloped section 75. Step 70 may facilitate supporting the pit 5 in a concrete basin or on a lattice-like structure as described below. Foot wall 65 may have a profile identical or substantially identical to head wall 30, and vice versa. Foot wall 65 and head wall 30 may have other suitable profiles. The end of foot section 15 and the abutting end of head section 10 preferably have matching cross-sections, that is, the cross-sections are preferably identical, or nearly identical. A second catch basin 40*b* is preferably formed in floor 55 to retain fluids that may enter pit 5. Foot section 10 preferably includes rear light rails 80 which receive a light (such as light 82 illustrated in front light rail 45) as described below. Lights 82 are optional. In a preferred embodiment, the upper surface of light rails 80 (flush with lip 85) provides a surface for the oil drain pan wheels to ride upon. As best seen in FIGS. 4 and 5, rear light rails 80 preferably have a rectangular cross section and are preferably approximately 4 and ⅞ inches high by approximately 4 and ¾ inches wide. However, other suitable dimensions may be used. Foot section 15 also preferably includes a lip 85 which overlies a building floor when the pit 5 is installed as described below. The floor 55, side walls 60, foot wall 65, second catch basin 40*b*, rear light rails 80, and lip 85 each have a suitable thickness for providing structural integrity during manufacture, shipping, installation, and use of the pit 5. Preferably, a suitable thickness is about ¼ of an inch, but may vary.

Figure 1:
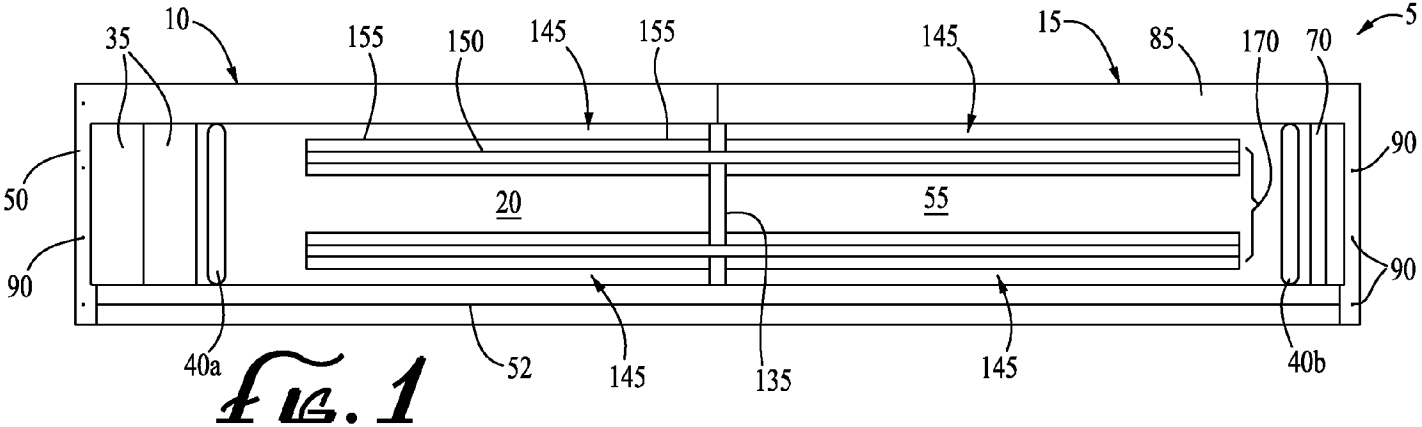
FIG. 1 is a top view of an exemplary service pit.

An optional guide rail 52 may be included over lips 50, 85. Only one guide rail 52 is illustrated in FIG. 1 for clarity, but preferably two such guide rails are included. Preferably, as shown in FIGS. 4 and 5A, the guide rail 52 forms an inverted "T" shape. Such a "T" shape may be made from two lengths of steel angle iron or other suitable construction or material. Optionally, the "T" shape may be extruded and made of metal, plastic, or other suitable material. Guide rail 52 is preferably secured to pit 5 by screws, bolts, adhesive, welding, or other suitable manner. Alternately, guide rail 52 may include an inverted "L" shape or other suitable shape. If constructed as a molded part, the guide rail 52 may be molded as a separate piece or molded as part of the head section 10 and the foot section 15.

Details of the inverted "T" shaped guide rail 52 are shown in FIG. 4 and the enlarged view of FIG. 5A. The stem of the "T" preferably extends approximately 1 inch to approximately 2 inches above the top surface of lips 50, 85. A first cross member 53 of the "T" located between the stem and the interior of pit 5 is preferably approximately 2 inches wide. A second cross member 54, that is, between the stem of the "T" and the exterior of pit 5, is preferably approximately 4 inches wide. First cross member 53 preferably provides a surface on which the wheels of a moveable oil drain pan run. Second cross member 54 preferably provides a surface on which wheels of a vehicle run. The stem portion of the "T" preferably prevents vehicle wheels from entering pit 5 and may simultaneously provide a guide for a mobile oil drain pan.

Head section 10 and foot section 15 each preferably have a length between approximately 134 inches and approximately 135 inches, but other suitable lengths may be used. Head section 10 and foot section 15 each preferably have a width between approximately 51 inches and approximately 52 inches, but other suitable widths may be used. Head section 10 and foot section 15 each preferably have a height between approximately 14 inches and approximately 22 inches, and preferably approximately 19 inches, but other suitable heights may be used. Lips 50 and 85 may include holes 90 through with screws or bolts may be inserted for securing head section 10 and foot section 15 to a building floor.

If light rails 45 or 80 are included in pit 5, a light 82 is preferably mounted on one or both of the front light rails 45 and the rear light rails 80. Optionally, the light 82 is a light designed to be used in a hazardous location where volatile components such as petrochemicals or fine dust may be suspended in the air without igniting the volatile components. One such light 82 is the Savi Floodstrip II model pre-wired light emitting diode (LED) light fixture manufactured by Nexxus Lighting of Charlotte, N.C., U.S.A. A preferred method for installing a light 82 on either, or both of, light rails 45, 80 is to cut an aperture through one or both of light rails 45, 80 into the interior of pit 5. The housing for light 82 is mounted on one or both of light rails 45, 80 and preferably fastened in place using adhesives, rivets, bolts, screws, or other suitable fastener. Wires for light 82 are preferably routed through the aperture and through one or both of light rails 45, 80. Using an LED light preferably permits installation on one or both of light rails 45, 80 without the need to seal light 82 from the interior of the pit 5.

Figure 6:
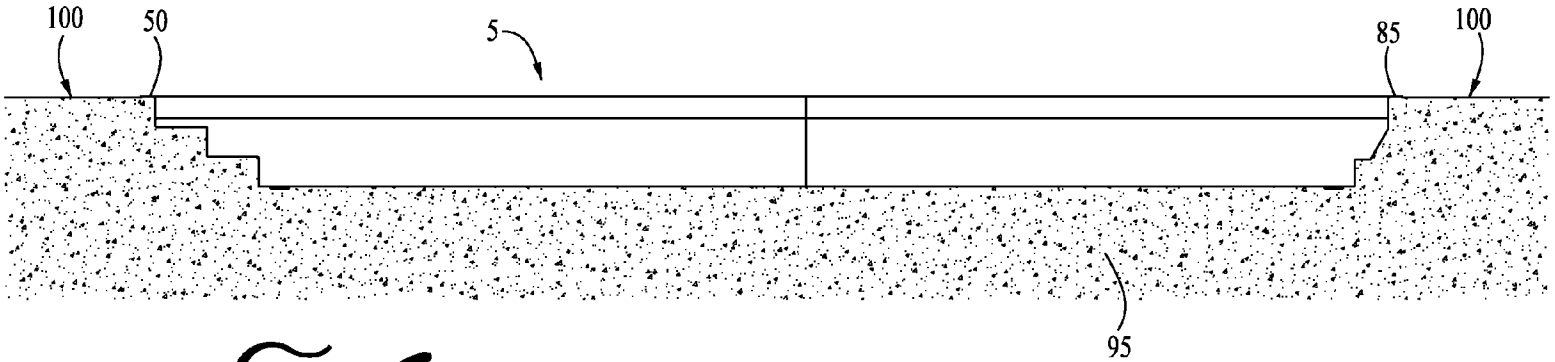
FIG. 6 is a left side view of the service pit of FIG. 1 supported by a concrete support structure.

FIG. 6 illustrates the pit 5 installed in a concrete floor 95. Lips 50 and 85 lie on the surface 100 of concrete floor 95. The remaining portions of head section 10 and foot section 15 are contained in a support structure such as a basin formed in the concrete floor 95. Optionally, a wood surround (not illustrated) secured to the concrete 95 by J-bolts may be included in the basin. A basin may be formed when concrete floor 95 is initially poured, or a basin may be formed by cutting through concrete floor surface 100, excavating a hole, and pouring the basin in the excavated hole. The support structure preferably conforms to the outer surfaces of head section 10 and foot section 15.

Figure 7:
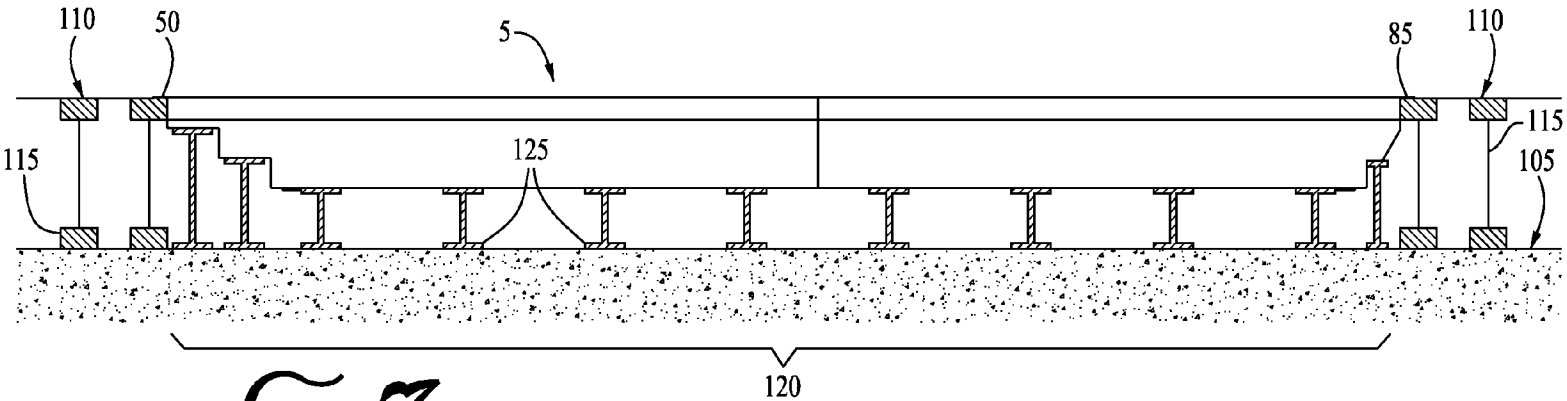
FIG. 7 is a left side view of the service pit of FIG. 1 supported by a lattice-like support structure commonly found in a modular facility with a floor and sub-floor.

FIG. 7 illustrates the pit 5 installed over sub-floor 105. The sub-floor 105 is preferably a grade level floor for a building so that pit 5 is above-grade, that is, above the surface of the ground on which the building rests. Such an above-grade installation may require fewer or less burdensome permits than a below-grade installation. Floor 110 is supported on sub-floor 105, for example, by trusses 115. A support structure such as a lattice-like structure 120 supports pit 5. Preferably, structural elements 125 are configured to conform to the outer surfaces of head section 10 and foot section 15. For example, structural elements 125 may be "I" beams with upper flanges contacting floors 20 and 55, the underside of steps 35 and 70, and portions of lips 50 and 85. Lattice-like structure 120 also preferably provides support for side walls 25 and 60. The lattice-like structure 120 may include structural elements 125 that are connected to one another, may include structural elements 125 that are not connected to one another, or a combination of connected and non-connected structural elements 125. Preferably structural elements 125 are steel, but other suitable materials or material combinations may be used.

When the pit 5 is installed in a support structure such as a concrete basin or a lattice-like structure 120, or other suitable support structure, portions of pit 5 are preferably connected to the support structure. Preferably, the relatively limited number of parts used to construct pit 5 may be assembled into pit 5 by one person without specific training for assembling pit 5. Lips 50 and 85 preferably overlie a floor surface such as 100 (FIG. 6) or 110 (FIG. 7) and are attached to the floor surface by fasteners (not illustrated) such as bolts or screws passing through apertures 90 and into the floor surface. Alternately, adhesives, caulks, or other suitable fasteners may secure lips 50 and 85 to a floor surface.

One end of head section 10 preferably abuts one end of foot section 15 and forms a seam (FIGS. 1-3, 6, and 7). As best illustrated in FIGS. 1 and 8, a generally U-shaped gasket 130 is located over the seam created by abutting head section 10 against foot section 15. The gasket 130 is preferably made from neoprene, but other suitable materials may be used. Gasket 130 is preferably approximately ⅛ to approximately 3/16 of an inch thick and approximately 6 inches to approximately 8 inches wide and extends at least part way up side walls 25 and 60. Gasket 130 preferably helps retard fluid from leaking out of pit 5. To facilitate assembly, the gasket may be secured to the joint plate 135, such as via an adhesive, or formed onto the joint plate 135.

As best illustrated in FIGS. 1, 8, and 9, joint plate 135 is located over gasket 130 when pit 5 is installed. Joint plate 135 is preferably generally U-shaped and approximately 6 inches wide. Joint plate 135 preferably extends up side walls 25 and 60 approximately the same distance as gasket 130. Fasteners 140 are preferably secured through joint plate 135, gasket 130, floors 20 and 55, and side walls 25 and 60. When pit 5 is installed in a concrete support structure, Buildex Tapcon® screws manufactured by Illinois Tool Works, Inc. of Schaumburg, Ill., U.S.A., are preferably used as fasteners 140, but other suitable concrete screws or anchors may be used. Lag bolts, rivets, machine screws or other suitable fasteners 140 are preferably used when pit 5 is supported by a metal support structure such as lattice-like structure 120 (FIG. 7). Epoxies, plastic welding, or other suitable fluid leakage resistant means may be used to join head section 10 and foot section 15 in addition to, or in place of, gasket 130. Joint plate 135 may optionally be used when epoxies, plastic welding, or other suitable fluid leakage resistant means are used.

FIGS. 10-12 illustrate runners 145, which preferably include rails 150 secured to feet 155. Rails 150 are preferably formed of steel with a hollow, semi-circular cross section. Other suitable materials and cross sections may be used. The feet 155 are also preferably steel, or other suitable material, and are secured to rails as an integral component, or may be welded, bolted or otherwise suitably fastened to the rail 150. In a preferred embodiment, rails 150 and feet 155 are made from a single piece of 12 gauge stainless steel. Apertures 160 (as shown in FIG. 10) are preferably included in feet 155 for securing runners 145 in pit 5 by fasteners 140 engaging the support structure. Preferably, feet 155 extend the entire length of rail 150, but breaks between feet 155 may be included. In some embodiments, a slip resistant tread (not illustrated) such as Tractionstep® flooring tread manufactured by ForBo Industries of Hazleton, Pa., U.S.A., is applied to floors 20, 55 between runners 145.

Figure 13:
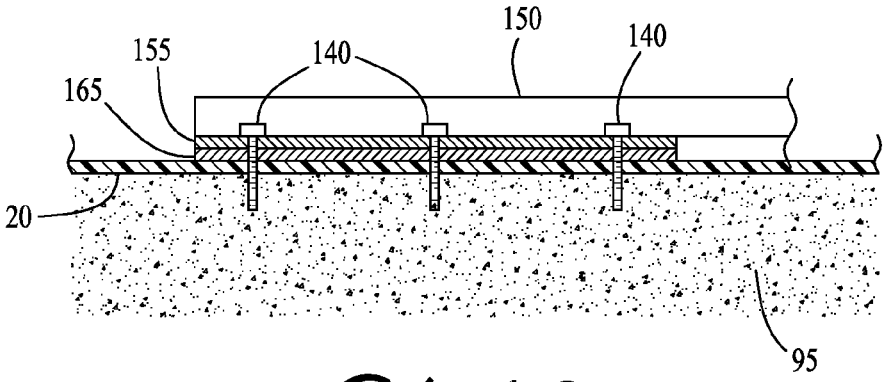
FIG. 13 is a left side cross sectional view of the runner of FIG. 10 installed in the pit of FIG. 1.
Figure 14:
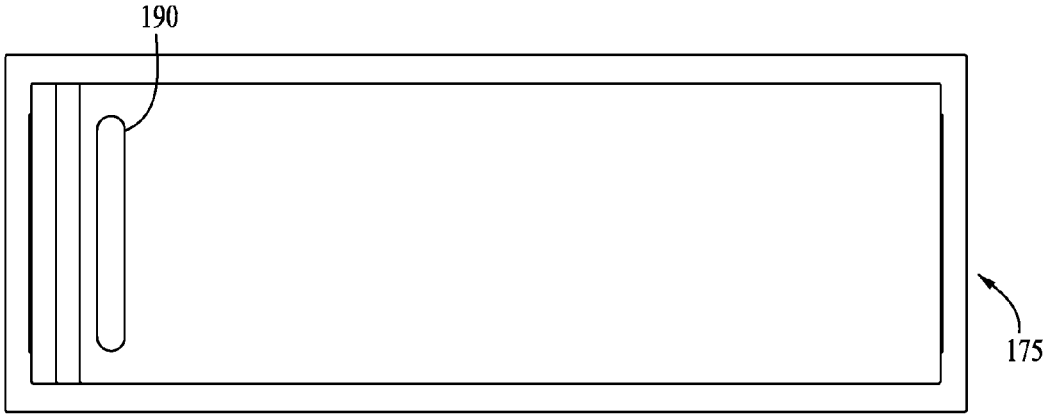
FIG. 14 is a top view of an exemplary rotational mold.
Figure 15:
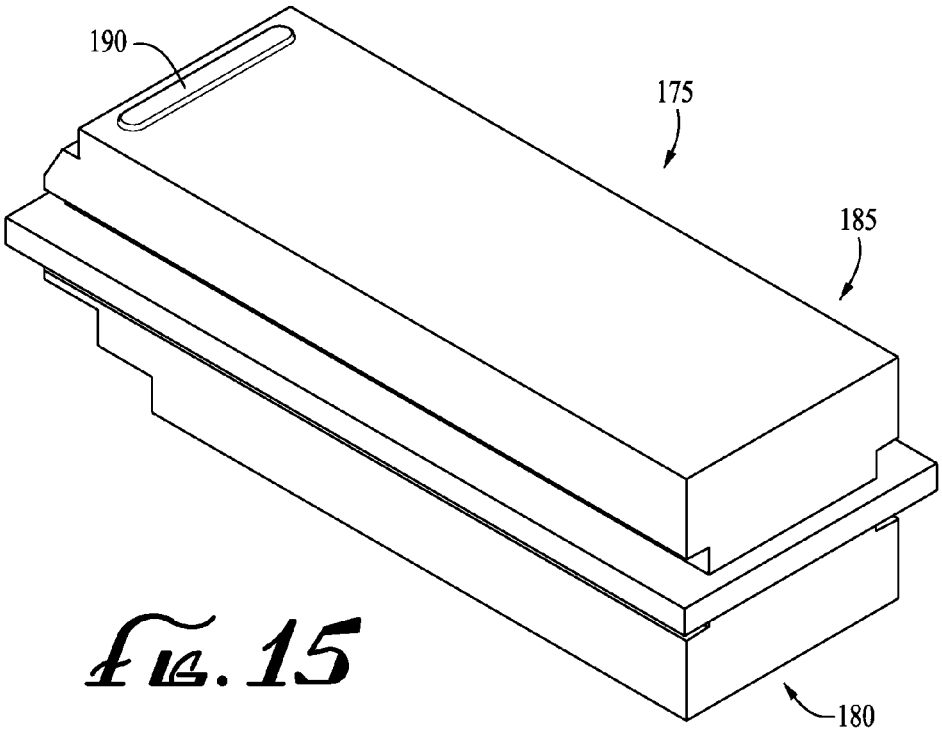
FIG. 15 is a top orthogonal view of the rotational mold of FIG. 14.
Figure 16:
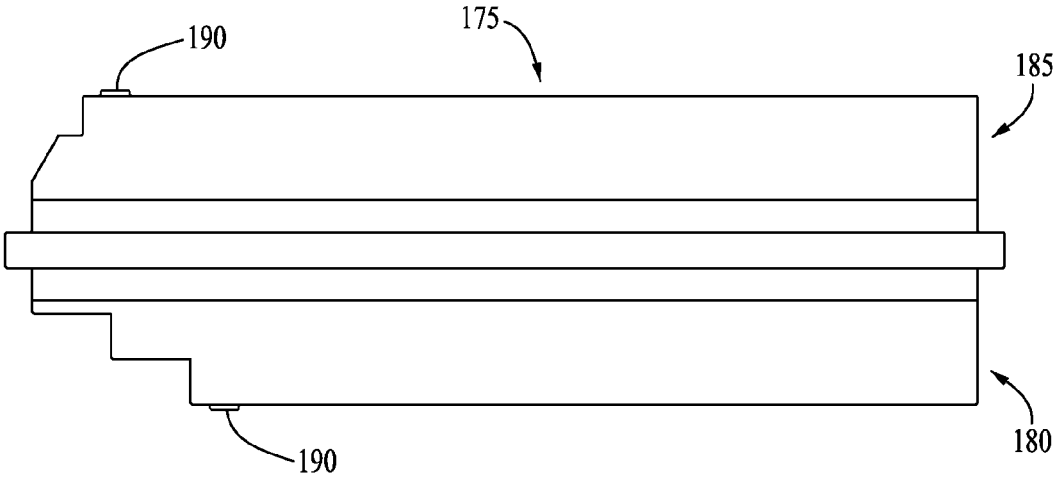
FIG. 16 is a left side view of the rotational mold of FIG. 14.
Figure 17:
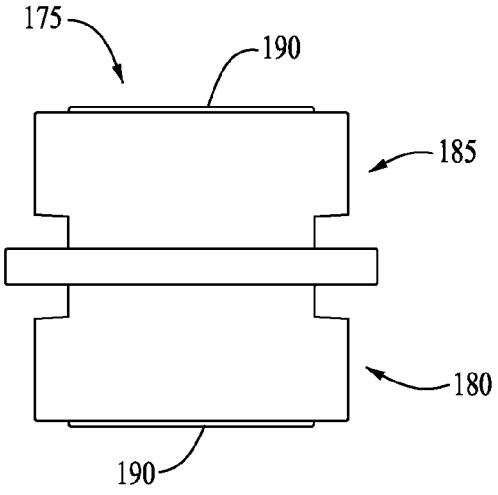
FIG. 17 is an end view of the rotational mold of FIG. 14.

Gaskets are preferably located between each foot 155 and floor 20 or 55 to help retard fluids in pit 5 from leaking through floor 20 or 55. As best illustrated in FIG. 13, a second gasket 165 is preferably located between each foot 155 and floor 20 to help retard fluids in pit 5 from leaking through floor 20. Similarly a third gasket is preferably located between each foot 155 and floor 55 to help retard fluids in pit 5 from leaking through floor 55. The second and third gaskets are preferably neoprene and sized to fit feet 155. For example, feet 155 may be approximately 56 and ⅞ inches long and approximately 3 inches wide. A corresponding gasket 165 is approximately 3 inches to approximately 4 inches wide and approximately 57 and ⅛ inches long. Other suitable dimensions may be used for feet 155 and gasket 165. Preferably runners 145 are approximately 120 inches long and ¾ of an inch high. Preferably, two runners 145 are secured in pit 5 end to end to form one track of a substantially parallel set of tracks 170 (FIG. 1). Alternately, the runners 145 may be other suitable lengths and heights. In particular embodiments a single runner 145 may form one track of a substantially parallel set of tracks, similar to tracks 170.

In a preferred use, pit 5 is used with a glider (not illustrated), such as a technician glider manufactured by New Century Buildings LLC of Portland, Oreg., U.S.A. A glider preferably movably mounts on tracks 170 to permit a user to have relatively easy access to various parts on the underside of a vehicle. Additionally, a preferred use of pit 5 includes a mobile oil drain pan (not illustrated) mounted on the top surface of light rails 45, 80, such as one manufactured by New Century Buildings LLC of Portland, Oreg., U.S.A. A mobile oil drain pan preferably permits a user to position the oil drain pan under various drain plugs including an oil drain, transmission drain, transfer case drain, transaxle drain, or a rear differential drain.

FIGS. 14-17 illustrate the outer surface of an exemplary rotational mold 175 used to mold head section 10 and foot section 15. Rotational mold 175 includes a lower portion 180 and an upper portion 185. Lower portion 180 is contoured to create head section 10 while upper portion 185 is contoured to create foot section 15. Rotational mold 175 preferably includes contours 190 for creating catch basins 40 as well as contours for creating other features described above. Rotational mold 175 is preferably loaded with a powdered polymer, such as low density polyethylene, before undergoing conventional rotational molding techniques. Preferably, head section 10 and foot section 15 have wall thicknesses of approximately ¼ of an inch and a combined weight of approximately 280 pounds after the rotational molding process. Other suitable manufacturing techniques may be used to form head section 10 and foot section 15, for example, but not limited to, injection molding, blow molding, and extruding.

It will be obvious to those having skill in the art that many changes may be made to the details of the above-described embodiments without departing from the underlying principles of the invention. The scope of the present invention should, therefore, be determined only by the claims below.

The invention claimed is:

1. A vehicle service pit structure comprising:

a pit head section;

a pit foot section positioned end to end with the pit head section and abutting the pit head section to form a seam between the pit foot section and the pit head section;

a support structure underlying the pit head section and the pit foot section;

a first gasket located over at least a portion of the seam;

a joint plate located over the first gasket;

a first plurality of fasteners compressing the first gasket and securing the joint plate to the pit head section and to the pit foot section by engaging the support structure; and a catch basin formed in at least one of the pit head section or the pit foot section.

2. A vehicle service pit structure comprising:

a pit head section;

a pit foot section positioned end to end with the pit head section and abutting the pit head section to form a seam between the pit foot section and the pit head section;

a support structure underlying the pit head section and the pit foot section;

a first gasket located over at least a portion of the seam;

a joint plate located over the first gasket;

a first plurality of fasteners compressing the first gasket and securing the joint plate to the pit head section and to the pit foot section by engaging the support structure;

a pair of substantially parallel tracks secured in the pit head section and in the pit foot section, wherein each track includes a track foot; and a gasket located between each track foot and the pit structure.

3. A vehicle service pit structure according to claim 1, further comprising:

a light rail formed in one of the pit head section or the pit foot section; and a light mounted in the light rail.

4. A vehicle service pit structure according to claim 1, further comprising:

a pair of substantially parallel tracks secured in the pit structure;

a light rail formed in one of the pit head section or the pit foot section; and a light mounted in the light rail.

5. A vehicle service pit structure according to claim 1, wherein the support structure comprises a concrete basin.

6. A vehicle service pit structure according to claim 1, wherein the support structure comprises a lattice-like support.

7. A vehicle service pit structure according to claim 6, wherein the lattice-like support is made from steel.

8. A method of constructing a vehicle service pit comprising:

placing a pit head section on a support structure, the pit head section having a first end and a second end;

placing a pit foot section on the support structure, the pit foot section having a first end and a second end wherein a cross-section of the pit foot second end substantially matches a cross-section of the pit head second end, so that the pit head second end abuts the pit foot second end;

placing a first gasket over at least a portion of the pit head section second end and over at least a portion of the pit foot section second end;

placing a joint plate over the first gasket;

securing the joint plate to the pit head section second end and to the support structure; and securing the joint plate to the pit foot section second end and to the support structure.

9. A method of constructing a vehicle service pit comprising:

placing a pit head section on a support structure, the pit head section having a first end and a second end;

placing a pit foot section on the support structure, the pit foot section having a first end and a second end wherein a cross-section of the pit foot second end substantially matches a cross-section of the pit head second end, so that the pit head second end abuts the pit foot second end;

placing a first gasket over at least a portion of the pit head section second end and over at least a portion of the pit foot section second end;

placing a joint plate over the first gasket;

securing the joint plate to the pit head section second end and to the support structure;

securing the joint plate to the pit foot section second end and to the support structure;

placing a first track having a foot in the pit head section and in the pit foot section;

placing a second track having a foot in the pit head section and in the pit foot section in a substantially parallel relationship with the first track;

placing a second gasket underneath the first track foot;

placing a third gasket underneath the second track foot;

securing the first track foot to the pit head end and the pit foot section and to the support structure;

securing the second track foot to the pit head section and the pit foot section and to the support structure.

10. A kit for constructing a vehicle service pit comprising a pit head section having and a second end;

a pit foot section having a first end and a second end wherein a cross-section of the pit foot second end substantially matches a cross-section of the pit head second end, so that the pit head second end abuts the pit foot second end;

a first gasket for covering at least a portion of the pit head section and at least a portion of the pit foot section;

a joint plate for covering the first gasket; and a light rail formed in at least one of the pit head section and the pit foot section.

11. A kit for constructing a vehicle service pit according to claim 10 further comprising a catch basin formed in one of (1) the pit head section, (2) the pit foot section, or (3) both the pit head section and the pit foot section.

12. A vehicle service pit structure according to claim 1 further comprising a light rail formed in at least one of the pit head section and the pit foot section.

* * * * *

UNITED STATES PATENT AND TRADEMARK OFFICE

CERTIFICATE OF CORRECTION

PATENT NO. : 8,646,226 B2
APPLICATION NO. : 12/914821
DATED : February 11, 2014
INVENTOR(S) : Peter J. Barram It is certified that error appears in the above-identified patent and that said Letters Patent is hereby corrected as shown below:

In the specification,

Column 3
Line 40, change "10" to --15--.

Column 4
Line 27, after "through" change "with" to --which--.

In the claims,

Column 8
Line 39, after "head section having" insert --a first end--.

Signed and Sealed this
Third Day of November, 2015

Michelle K. Lee

Michelle K. Lee
*Director of the United States Patent and Trademark Office*